US005632917A

United States Patent [19]

Cummins et al.

[11] Patent Number: 5,632,917

[45] Date of Patent: May 27, 1997

[54] ELECTRIC WINDSHIELD DEFROSTER

[75] Inventors: James M. Cummins; Gene R. Burnham, both of Dearborn; William A. Oestreich, Westland; James D. Boka, Walled Lake, all of Mich.

[73] Assignee: Ford Motor Company, Dearborn, Mich.

[21] Appl. No.: 285,538

[22] Filed: Aug. 8, 1994

[51] Int. Cl.[6] ..... H05B 1/02

[52] U.S. Cl. ..... 219/497; 219/501; 219/202; 219/481; 307/117

[58] Field of Search ..... 219/202–206, 219/481, 497, 501, 505, 508, 510, 494; 307/117, 119

[56] References Cited

U.S. PATENT DOCUMENTS

| | | | |
|---|---|---|---|
| 3,564,388 | 2/1971 | Nolf | 321/18 |
| 3,584,291 | 6/1971 | Budniak et al. | 219/501 |
| 3,863,140 | 1/1975 | Easter et al. | 323/17 |
| 4,015,145 | 3/1977 | Stewart | 307/293 |
| 4,188,527 | 2/1980 | Follmer . | |
| 4,277,672 | 7/1981 | Jones . | |
| 4,423,307 | 12/1983 | Kondo et al. | 219/202 |
| 4,520,258 | 5/1985 | Grohmann . | |
| 4,591,691 | 5/1986 | Badali | 219/202 |
| 4,967,137 | 10/1990 | Canitrot et al. . | |
| 5,107,094 | 4/1992 | Kuhn et al. . | |
| 5,187,349 | 2/1993 | Curhan et al. | 219/202 |

*Primary Examiner*—Mark H. Paschall
*Attorney, Agent, or Firm*—Mark S. Sparschu

[57] ABSTRACT

A windshield heating system includes a heating element installed in the defroster ductwork of a motor vehicle. An electrical driver provides electrical power to heat the heating element, thereby immediately providing heated air to the windshield of the vehicle when the vehicle is started in cold weather. The electrical power provided to the heating element can be modulated based on (1) temperature of the air before the heating element, (2) temperature of the heating element, and (3) system voltage of the vehicle.

9 Claims, 3 Drawing Sheets

ELECTRIC WINDSHIELD DEFROSTER

BACKGROUND OF THE INVENTION

1. Field of the Invention

The present invention relates to automotive window clearing systems generally, and more specifically to automotive windshield defrosting systems.

2. Description of the Related Art

In motor vehicles operated in cool climates, the need often arises to defrost the windows of the vehicle. The oldest method of defrosting the windows is with a forced-air defroster system, which directs heated air to the windows. The air is typically heated by a heater core through which engine coolant is circulated.

However, in some applications, particularly trucks with diesel engines, it can take a very long time for the engine coolant to warm to the point that the heater core can transfer significant heat to air directed toward the windows. In this case, a system which begins delivering heat immediately will be advantageous.

One such system which begins to deliver heat immediately employs a conductive layer embedded in the windshield. Electric current is applied to the conductive layer, causing it to heat.

Although such a heated windshield system is effective, it is fairly expensive. Additionally, in truck applications, windshields are often chipped or cracked due to stones kicked up against the windshield. Frequent replacement of the windshield of such a heated windshield system can be very costly.

An additional concern in the application of such a heated windshield system is that the conductor embedded in the windshield presents a very substantial load on the vehicle charging system. Without effective control of energy provided to the conductor, other electrical devices on the vehicle can be deprived of sufficient power to operate properly. Further, the battery of the vehicle can become discharged, leading to inability to start the vehicle during a subsequent attempt to start it.

Therefore, a system which provides immediate heat to a windshield without requiring a conductor embedded in the windshield and without over-taxing the vehicle's charging system can provide advantages over the prior art.

SUMMARY OF THE INVENTION

The present invention provides a windshield heating apparatus for a motor vehicle having at least one air duct and a heater core adapted to heat air passing within the air duct. The windshield heating apparatus includes an electrical heating element located within the air duct. Further, the windshield heating apparatus includes an electrical driver coupled to the electrical heating element and adapted to provide electric current through the electrical heating element. Additionally, the windshield heating apparatus comprises a first temperature sensor positioned to measure a heating capability of the heater core. The windshield heating apparatus also includes first modulating means coupled to the first temperature sensor and to the electrical driver for modulating electric current through the electrical heating element in response to the first temperature sensor.

The present invention also provides a windshield heating apparatus for a motor vehicle having an engine with engine coolant, at least one air duct and a heater core adapted to heat air passing within the air duct. The windshield heating apparatus includes an electrical heating element located within the air duct. In addition, the windshield heating apparatus comprises an electrical driver coupled to the electrical heating element and adapted to provide electric current through the electrical heating element. Further, the windshield heating apparatus includes a first temperature sensor positioned to measure an air-heating capability of the heater core. Also, the windshield heating apparatus includes a modulator with an input and an output, the input coupled to the first temperature sensor and the output coupled to the electrical driver.

The present invention also provides a windshield heating apparatus for a motor vehicle having an interior and having at least one air duct adapted to provide heated air into the interior. The windshield heating apparatus comprises an electrical heating element located within the air duct. Further, the windshield heating apparatus comprises an electrical driver coupled to the electrical heating element and adapted to provide electric current through the electrical heating element. In addition, the windshield heating apparatus includes means for sensing a system voltage of the vehicle. Also, the apparatus comprises a modulator with an input and an output, the input coupled to the system voltage sensing means and the output coupled to the electrical driver.

The present invention provides immediate heat to a windshield without requiring a conductor embedded in the windshield. The invention thus provides cost advantages over prior art systems. Further, the system uses only the excess energy available from the vehicle charging system, so that the charging system will not become over-taxed.

DETAILED DESCRIPTION OF THE PREFERRED EMBODIMENTS

Figure 1:
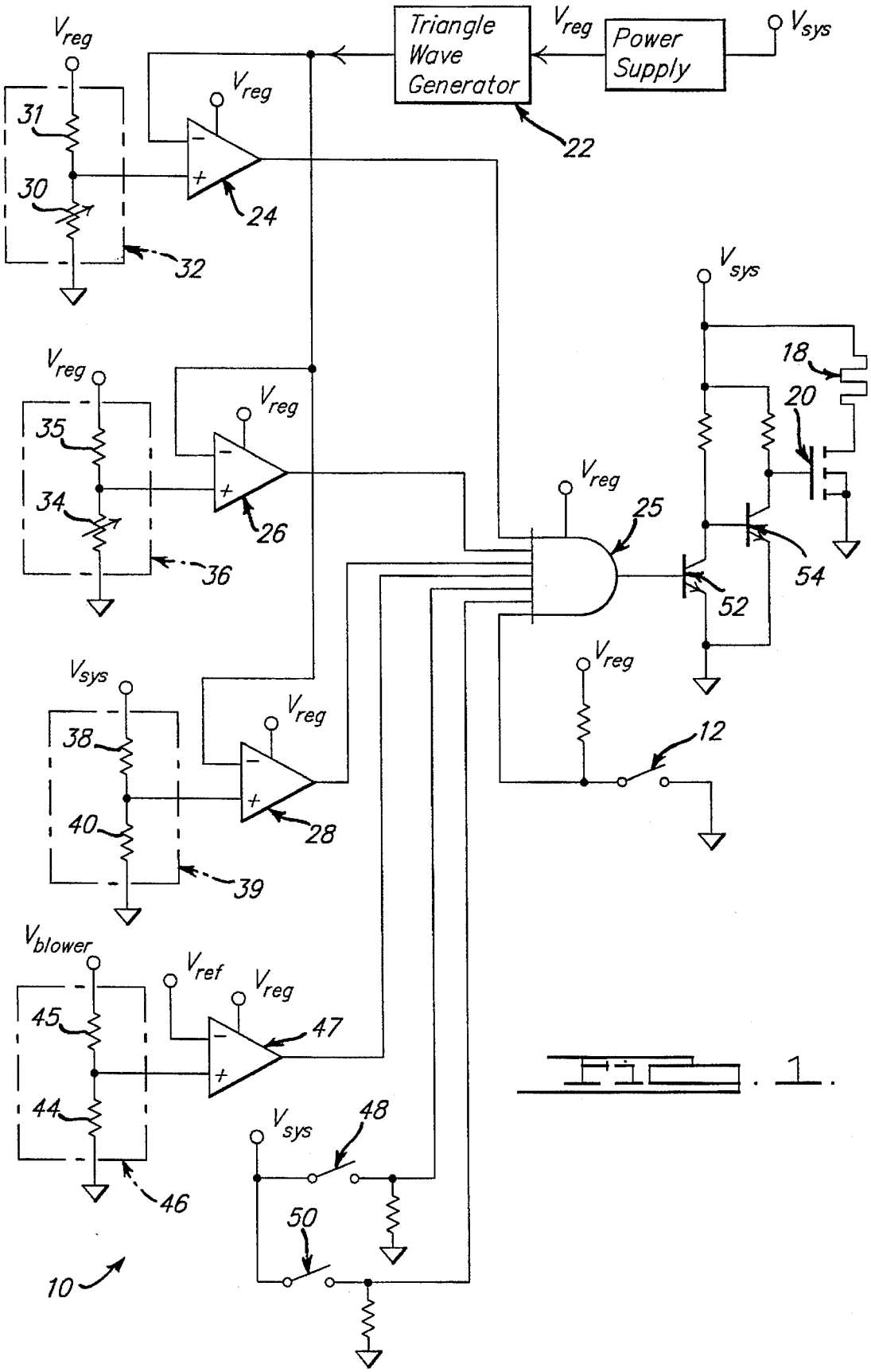
FIG. 1 is an electrical schematic of a windshield heating system 10 according to one embodiment of the present invention.

Referring to FIG. 1, a windshield heating system 10 for a vehicle according to one embodiment of the present invention is illustrated.

A power supply 16 converts system voltage (nominally 14 volts) to a regulated voltage for use in various places by heating system 10. Power supply 16 can be any of a number of known voltage regulators, such as an LM317-type voltage regulator integrated circuit. The regulated voltage $V_{reg}$ generated by power supply 16 is preferably approximately 8 volts.

One or more heating elements 18 is the source of heat for windshield defrosting system 10. Heating element 18 is located within the defroster ductwork of the vehicle, between the heater core and the defroster nozzle. Heating element 18 can be chosen from a number of devices, including standard high-wattage resistors, positive temperature coefficient ceramic resistors, bipolar power transistors and field-effect power transistors. Heating element 18 is provided current via electrical driver 20. Electrical driver 20, though shown as a single field-effect transistor (FET), can in fact be as many FETs as necessary connected in parallel in order to drive sufficient current through heating element 18.

Electrical driver 20 can also be configured using bipolar junction transistors or other semiconductor power devices.

A control switch 12 is provided to allow the driver of the vehicle to activate and deactivate heating element 18. Control switch 12 can also be a pushbutton-type momentary contact switch which feeds a timer circuit (as in most rear-window electric-grid defogger systems). The timer circuit would provide a logic HIGH output voltage while the timer remains unexpired. Heating element 18 would thus automatically turn off after a predetermined period of time.

Figure 1A:
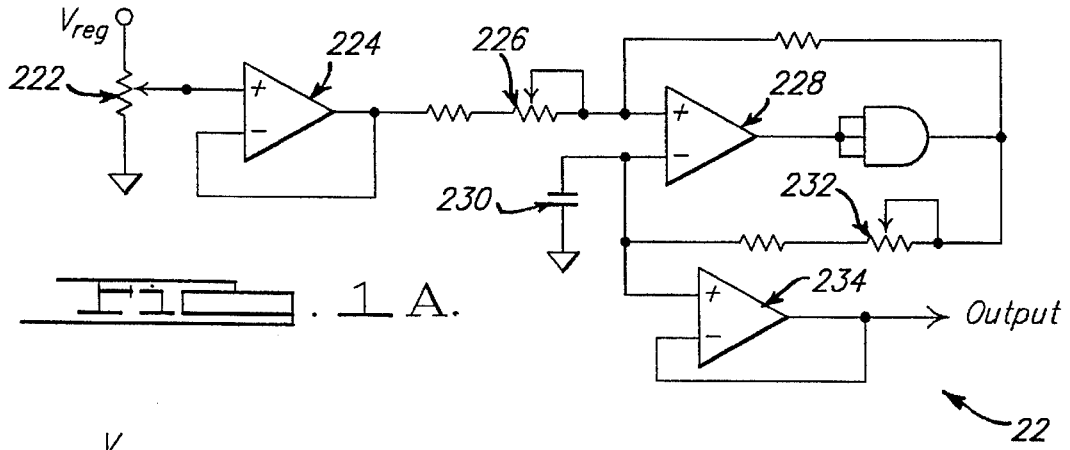
FIG. 1A is an electrical schematic of triangle wave generator 22 of windshield heating system 10 of FIG. 1.

One of items powered by power supply 16 is triangle wave generator 22. Referring now to FIG. 1A, a preferred configuration of triangle wave generator 22 is illustrated. $V_{reg}$, the regulated output voltage from power supply 16 (FIG. 1), is supplied to potentiometer 222. Potentiometer 222 is used to select the DC level of the triangle wave produced by triangle wave generator 22. Amplifier 224 is configured as a unity-gain amplifier, to buffer the output of potentiometer 222. Potentiometer 226 then selects the amplitude of the triangle wave produced by triangle wave generator 22. Comparator 228 is configured to oscillate, with the charging and discharging of capacitor 230 causing the ramping up and down which defines the triangle wave produced by triangle wave generator 22. Potentiometer 232 controls the frequency of the charging and discharging of capacitor 230, and therefore controls the frequency of the triangle wave. Amplifier 234 is configured as a unity-gain amplifier, to buffer the triangle-wave signal produced by the charging and discharging of capacitor 230.

Those skilled in the art will recognize that there are a multitude of other circuits which will produce a triangle-wave signal. Those other circuits can replace the specific configuration of triangle wave generator 22 which is disclosed in FIG. 1A. For example, a 555-type integrated circuit can act as triangle wave generator 22.

Referring again to FIG. 1, the output of triangle wave generator 22 is provided as an input to comparators 24, 26 and 28.

Temperature sensor 30 is preferably located within the defroster ductwork, between the heater core and heating element 18. Other preferred locations for temperature sensor 30 include: (1) within the heater core of the vehicle; and (2) in thermal contact with the engine coolant of the engine of the vehicle. Temperature sensor 30 thus senses the extent to which the heater core is able to heat the air being provided through the defroster ductwork to the windshield. Temperature sensor 30 is preferably a negative temperature coefficient thermistor. With resistor 31, temperature sensor 30 forms a voltage divider 32. The output of voltage divider 32 is provided as an input to comparator 24. The output of comparator 24 is coupled to an input of AND gate 25.

Temperature sensor 34 is located in very close proximity to heating element 18, to allow sensing of the temperature of heating element 18. Temperature sensor 34 is preferably a negative temperature coefficient thermistor. Temperature sensor 34 forms a voltage divider 36 with resistor 35. The output of voltage divider 36 is provided as an input to comparator 26. The output of comparator 26 is coupled to an input of AND gate 25.

A voltage divider 39 formed by the combination of resistor 38 and resistor 40 is powered by system voltage. The output of the voltage divider is provided as an input to comparator 28, as an indication of the system voltage of the vehicle. The output of comparator 28 is coupled to an input of AND gate 25.

A voltage divider 46 formed by the combination of resistor 44 and resistor 45 is connected in parallel with the blower motor of the vehicle. The output of voltage divider 46 is provided as an input to comparator 47, as an indication of the voltage applied to the blower motor (and therefore the speed of the blower motor). A fixed reference voltage $V_{ref}$ is applied to the other input of comparator 47. $V_{ref}$ is selected to be a voltage threshold between the voltages across the blower motor when the blower motor is operated at MEDIUM speed and when the blower motor is operated at LOW speed. Comparator 47 is thus able to determine whether the blower motor is operating at MEDIUM or HIGH speed, or whether the blower motor is operating below MEDIUM or HIGH speed. The output of comparator 47 is coupled to an input of AND gate 25.

Oil pressure switch 48 is connected at one side to system voltage and at the other side to an input of AND gate 25. Oil pressure switch 48 closes when the engine is running and opens which the engine is not running. Oil pressure switch 48 thus provides system 10 with an indication regarding whether the engine of the vehicle is running.

Windshield defroster switch 50 is the selector switch which the driver of the vehicle uses in order to cause his conventional forced-air windshield defroster to turn on. Windshield defroster switch 50 is coupled at one side to system voltage and at the other side to AND gate 25. Windshield defroster switch 50 provides an indication that the driver of the vehicle wishes his/her windshield defrosted.

Figure 2:
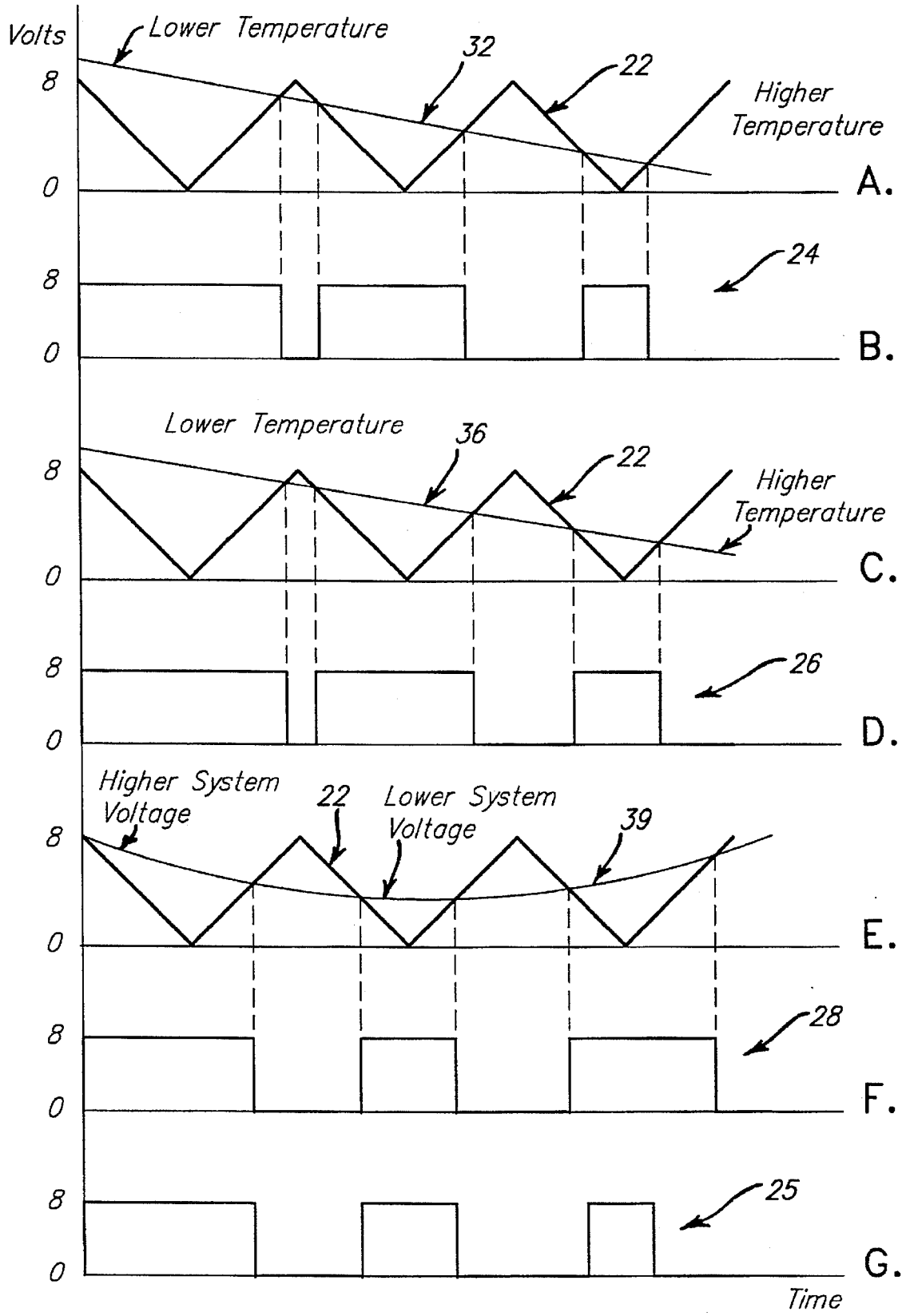
FIG. 2 is a timing diagram showing various signals in the circuit of FIG. 1.

The operation of system 10 will now be described with reference to FIGS. 1 and 2. Trace "A" of FIG. 2 illustrates the output of triangle wave generator 22 and the signal provided by voltage divider 32. Recall that those two signals are the inputs to comparator 24. Trace "B" of FIG. 2 shows the output of comparator 24. It will be noticed that as long as the output of voltage divider 32 is greater than the output of triangle wave generator 22, the output of comparator 24 will be high. Moving from left to right in Trace "B", we see that as the temperature sensed by voltage divider 32 increases, the width of the pulse at the output of comparator 24 narrows. This narrowing is in recognition of the fact that as the vehicle's heater core warms up, it will need less assistance from heating element 18 in warming the air in the defroster ductwork of the vehicle.

Trace "C" of FIG. 2 illustrates the output of triangle wave generator 22 and the signal provided by voltage divider 36. Recall that those two signals are the inputs to comparator 26. Trace "D" of FIG. 2 shows the output of comparator 26. It will be noticed that as long as the output of voltage divider 36 is greater than the output of triangle wave generator 22, the output of comparator 26 will be high. Moving from left to right in Trace "D", we see that as the temperature sensed by voltage divider 36 increases, the width of the pulse at the output of comparator 26 narrows. This narrowing is in recognition of the fact that as heating element 18 warms up, electrical power should be supplied to it less of the time. This prevents heating element 18 from being operated above its maximum intended operating temperature.

Trace "E" of FIG. 2 illustrates the output of triangle wave generator 22 and the signal provided by voltage divider 39. Recall that those two signals are the inputs to comparator 28. Trace "F" of FIG. 2 shows the output of comparator 28. It will be noticed that as long as the output of voltage divider 39 is greater than the output of triangle wave generator 22, the output of comparator 28 will be high. Moving from left to right in Trace "E", we see that as the system voltage sensed by voltage divider 39 decreases, the width of the pulse at the output of comparator 28 narrows. This narrowing is in recognition of the fact that as system voltage dips, less electrical power should be supplied to heating element 18, to prevent excessive loading on the power generation system of the vehicle. System 10 thus is able to use all power generating capability of the vehicle which is not required for other purposes.

Trace "G" illustrates the output of AND gate 25. The reader will notice that Trace "G" is the ANDing of Traces "B", "D" and "F". It is assumed that the blower motor of the vehicle is in the MEDIUM or HIGH position, so the output of comparator 46 is high. Further, it is assumed that oil pressure switch 48 is closed (indicating that the engine is running) and defroster switch 50 is closed (indicating that the driver has commanded his conventional forced-air defroster to be on). Additionally, it is assumed that control switch 12 is open, so a high signal is provided from control switch 12 to AND gate 25.

The signal illustrated as Trace "G", being the output of AND gate 25, is provided to electrical driver 20. (Transistors 52 and 54 are provided as needed to provide proper polarity for the operation of electrical driver 20.) During the times when Trace "G" is high, then, electrical driver 20 provides electrical current to heating element 18. System 10 thus provides power to heating element 18, the power being modulated based on the temperature of the air leaving the heater core, the temperature of heating element 18, and system voltage.

Figure 3:
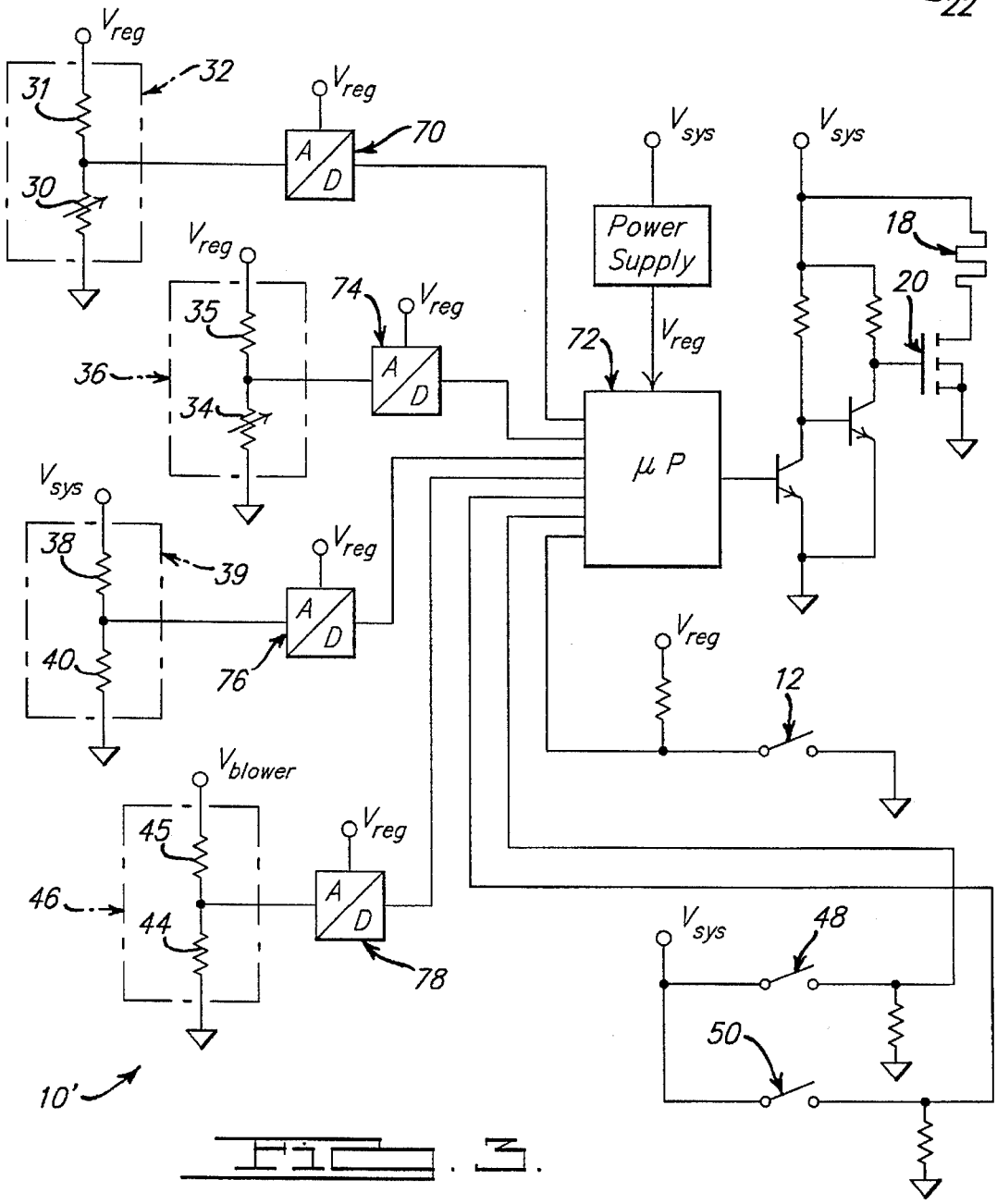
FIG. 3 is an electrical schematic of a windshield heating system 10' according to a second embodiment of the present invention.

FIG. 3 illustrates a second embodiment of the present invention. Windshield heating system 10' comprises electrical heating element 18 and electrical driver 20. Control switch 12 is actuated by the driver of the vehicle in order to activate and deactivate heating element 18. Power supply 16 converts system voltage (nominally 14 volts) to a regulated voltage for use in various places by heating system 10'.

Voltage divider 32 comprises temperature sensor 30, which is located within the defroster ductwork between the heater core and heating element 18. The output of voltage divider 32 is provided as an input to analog-to-digital (A/D) converter 70. The output of A/D converter 70 is coupled to an input of microprocessor 72.

Temperature sensor 34 is located in very close proximity to heating element 18, to allow sensing of the temperature of heating element 18. Temperature sensor 34 forms a voltage divider 36 with resistor 35. The output of voltage divider 36 is provided as an input to A/D converter 74. The output of A/D converter 74 is coupled to an input of microprocessor 72.

Voltage divider 39 formed by the combination of resistor 38 and resistor 40 is powered by system voltage. The output of the voltage divider is provided as an input to A/D converter 76, as an indication of the system voltage of the vehicle. The output of A/D converter 76 is coupled to an input of microprocessor 72.

Voltage divider 46 formed by the combination of resistor 44 and resistor 45 is connected in parallel with the blower motor of the vehicle. The output of voltage divider 46 is provided as an input to A/D converter 78, as an indication of the voltage applied to the blower motor (and therefore the speed of the blower motor). The output of A/D converter 76 is coupled to an input of microprocessor 72.

Oil pressure switch 48 is connected at one side to system voltage and at the other side to an input of microprocessor 72. Oil pressure switch 48 thus provides heating system 10' with an indication regarding whether the engine of the vehicle is running.

Windshield defroster switch 50 is coupled at one side to system voltage and at the other side to microprocessor 72. Windshield defroster switch 50 provides an indication that the driver of the vehicle wishes his/her windshield defrosted.

Microprocessor 72 provides, in software, the function provided by the circuitry of FIG. 1. That is, microprocessor 72 modulates the power delivered to electrical heating element 18 based on the temperature of the air leaving the heater core, the temperature of heating element 18, and system voltage. Further, microprocessor 72 turns off the power to heating element 18 if the engine is not running, if the blower motor is not in the MEDIUM or HIGH speed position, if the conventional forced-air defroster is not turned on, or if the driver of the vehicle closes control switch 12 to deactivate heating element 18.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A windshield heating apparatus for a motor vehicle having an engine with engine coolant, at least one air duct and a heater core adapted to heat air passing within said air duct, said apparatus comprising:

an electrical heating element located within said air duct;

an electrical driver coupled to said electrical heating element and adapted to provide electric current through said electrical heating element;

means for sensing a temperature of said heater core or of said engine coolant;

first modulating means coupled to said temperature sensing means and to said electrical driver for modulating said electric current through said electrical heating element in response to said temperature sensing means;

means for sensing a system voltage of said vehicle;

second modulating means coupled to said system voltage sensing means and to said electrical driver for modulating said electric current through said electrical heating element in response to said system voltage sensing means;

a temperature sensor mounted in proximity with said electrical heating element to measure the temperature of said electrical heating element; and third modulating means coupled to said temperature sensor and to said electrical driver for modulating said electric current through said electrical heating element in response to said temperature sensor.

2. A windshield heating apparatus as recited in claim 1, further comprising:

analog means for sensing a blower speed of said vehicle; and first switching means coupled to said analog blower speed sensing means and to said electrical driver for switching said electric current through said electrical heating element in response to said analog blower speed sensing means.

3. A windshield heating apparatus as recited in claim 2, further comprising:

means for detecting whether said engine is running; and second switching means coupled to said detecting means and to said electrical driver for switching said electric current through said electrical heating element in response to an engine running or not running condition.

4. A windshield heating apparatus as recited in claim 3, wherein:

said first modulating means comprises a triangle-wave generator and a first comparator having a first input and a second input, said first input coupled to said first temperature sensor and said second input coupled to said triangle-wave generator;

said second modulating means comprises a triangle-wave generator and a second comparator having a first input and a second input, said first input coupled to said system voltage sensing means and said second input coupled to said triangle-wave generator;

said third modulating means comprises a triangle-wave generator and a third comparator having a first input and a second input, said first input coupled to said second temperature sensor and said second input coupled to said triangle-wave generator; and said first switching means comprises a fourth comparator having a first input and a second input, said first input coupled to said blower speed sensing means and said second input coupled to a fixed reference voltage; and said second switching means comprises an oil pressure switch.

5. A windshield heating apparatus as recited in claim 3, wherein:

said first modulating means comprises a first analog-to-digital converter coupled to said first temperature sensor and a microprocessor coupled to said first analog-to-digital converter and to said electrical driver;

said second modulating means comprises a second analog-to-digital converter coupled to said system voltage sensing means and a microprocessor coupled to said second analog-to-digital converter and to said electrical driver;

said third modulating means comprises a third analog-to-digital converter coupled to said second temperature sensor and a microprocessor coupled to said third analog-to-digital converter and to said electrical driver;

said first switching means comprises a fourth analog-to-digital converter coupled to said blower speed sensing means and a microprocessor coupled to said analog-to-digital converter and to said electrical driver; and said second switching means comprises an oil pressure switch and a microprocessor coupled to said oil pressure switch and to said electrical driver.

6. A windshield heating apparatus for a motor vehicle having an engine with engine coolant, at least one air duct and a heater core adapted to heat air passing within said air duct, said apparatus comprising:

an electrical heating element located within said air duct;

an electrical driver coupled to said electrical heating element and adapted to provide electric current through said electrical heating element;

means for sensing a temperature of said heater core or of said engine coolant;

a modulator with an input and an output, said input coupled to said temperature sensing means and said output coupled to said electrical driver; and a temperature sensor mounted in proximity with said electrical heating element to measure the temperature of said electrical heating element; wherein said modulator has a second input, said second input coupled to said temperature sensor.

7. A windshield heating apparatus as recited in claim 6, wherein said modulator is adapted to provide a fixed-frequency, variable-duty-cycle output.

8. A windshield heating apparatus for a motor vehicle having an interior and having at least one air duct adapted to provide heated air into said interior, said apparatus comprising:

an electrical heating element located within said air duct;

an electrical driver coupled to said electrical heating element and adapted to provide electric current through said electrical heating element;

means for sensing a system voltage of said vehicle;

a modulator with an input and an output, said input coupled to said system voltage sensing means and said output coupled to said electrical driver; and a temperature sensor mounted in proximity with said electrical heating element to measure the temperature of said electrical heating element; wherein said modulator has a second input, said second input coupled to said temperature sensor.

9. A windshield heating apparatus as recited in claim 8, wherein said modulator is adapted to provide a fixed-frequency, variable-duty-cycle output.

* * * * *